US007967083B2

(12) United States Patent
Hall et al.

(10) Patent No.: US 7,967,083 B2
(45) Date of Patent: Jun. 28, 2011

(54) SENSOR FOR DETERMINING A POSITION OF A JACK ELEMENT

(75) Inventors: David R. Hall, Provo, UT (US); Jim Shumway, Lehi, UT (US); David Wahlquist, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 12/614,668

(22) Filed: Nov. 9, 2009

(65) Prior Publication Data

US 2010/0044109 A1 Feb. 25, 2010

Related U.S. Application Data

(63) Continuation-in-part of application No. 11/851,095, filed on Sep. 6, 2007, now Pat. No. 7,721,826.

(51) Int. Cl.
*E21B 10/06* (2006.01)
*E21B 17/10* (2006.01)

(52) U.S. Cl. ..... 175/45; 175/61; 175/332; 175/408; 175/415; 175/385

(58) Field of Classification Search ..... 175/40, 175/45, 61, 408, 415, 95, 107, 333, 322, 175/385, 73, 74
See application file for complete search history.

(56) References Cited

U.S. PATENT DOCUMENTS 616,118 A 12/1889 Kunhe
465,103 A 12/1891 Wagner
923,513 A 5/1909 Hardsocg
946,060 A 1/1910 Looker
1,116,154 A 11/1914 Stowers
1,183,630 A 5/1916 Bryson
1,189,560 A 7/1916 Gondos
1,360,908 A 11/1920 Everson
1,372,257 A 3/1921 Swisher
1,387,733 A 8/1921 Midgett
1,460,671 A 7/1923 Hebsacker
1,544,757 A 7/1925 Hufford
1,746,455 A 2/1930 Woodruff et al.
1,746,456 A 2/1930 Allington
1,821,474 A 9/1931 Mercer
1,836,538 A 12/1931 Wright et al.

(Continued)

OTHER PUBLICATIONS

US 9,629,076, Apr. 2005, Fenuel.

(Continued)

*Primary Examiner* — Daniel P Stephenson
*Assistant Examiner* — Yong-Suk Ro
(74) *Attorney, Agent, or Firm* — Holme Roberts & Owen LLP

(57) ABSTRACT

A drill string having a drill bit with a bit body located between a shank and a working face. The working face has at least one cutting element and a jack element disposed partially within the drill bit body and partially protruding from the working face. The jack element is adapted to be rotated with respect to the bit body by a driving mechanism disposed within a bore of the drill string. A generator or motor with a rotor is incorporated into a torque transmitting mechanism that links the driving mechanism to the jack element, and configured so that at least one waveform is produced in the generator or motor when the jack element is rotated. The waveform is processed by an electronic processing device to determine the rotational position of the jack element.

20 Claims, 9 Drawing Sheets

U.S. PATENT DOCUMENTS

| | | | | |
|---|---|---|---|---|
| 1,879,177 | A | | 9/1932 | Gualt |
| 2,054,255 | A | | 9/1936 | Howard |
| 2,064,255 | A | | 12/1936 | Garfield |
| 2,169,223 | A | | 8/1939 | Christian |
| 2,196,940 | A | | 4/1940 | Potts |
| 2,218,130 | A | | 10/1940 | Court |
| 2,227,233 | A | * | 12/1940 | Noble et al. ..... 175/80 |
| 2,300,016 | A | | 10/1942 | Scott et al. |
| 2,320,136 | A | | 5/1943 | Kammerer |
| 2,345,024 | A | | 3/1944 | Bannister |
| 2,371,248 | A | | 3/1945 | McNamara |
| 2,466,991 | A | | 4/1949 | Kammerer |
| 2,540,464 | A | | 2/1951 | Stokes |
| 2,544,036 | A | | 3/1951 | Kammerer |
| 2,575,173 | A | | 11/1951 | Johnson |
| 2,619,325 | A | | 1/1952 | Arutunoff |
| 2,626,780 | A | | 1/1953 | Ortloff |
| 2,643,850 | A | | 6/1953 | Koch |
| 2,725,215 | A | | 11/1955 | MacNeir |
| 2,755,071 | A | | 7/1956 | Kammerer |
| 2,776,819 | A | | 1/1957 | Brown |
| 2,819,041 | A | | 1/1958 | Beckham |
| 2,819,043 | A | | 1/1958 | Henderson |
| 2,838,284 | A | | 6/1958 | Austin |
| 2,873,093 | A | | 2/1959 | Hildebrandt et al. |
| 2,877,984 | A | | 3/1959 | Causey |
| 2,901,223 | A | | 6/1959 | Scott |
| 2,894,722 | A | | 7/1959 | Buttolph |
| 2,942,850 | A | | 6/1960 | Heath |
| 2,963,102 | A | | 12/1960 | Smith |
| 2,998,085 | A | | 8/1961 | Dulaney |
| 3,036,645 | A | | 5/1962 | Rowley |
| 3,055,443 | A | | 9/1962 | Edwards |
| 3,058,532 | A | | 10/1962 | Alder |
| 3,075,592 | A | | 1/1963 | Overly et al. |
| 3,077,936 | A | | 2/1963 | Arutunoff |
| 3,135,341 | A | | 6/1964 | Ritter |
| 3,139,147 | A | | 6/1964 | Hays et al. |
| 3,163,243 | A | | 12/1964 | Cleary |
| 3,216,514 | A | | 11/1965 | Nelson |
| 3,294,186 | A | | 12/1966 | Buell |
| 3,301,339 | A | | 1/1967 | Pennebaker |
| 3,303,899 | A | | 2/1967 | Jones et al. |
| 3,336,988 | A | | 8/1967 | Jones |
| 3,379,264 | A | | 4/1968 | Cox |
| 3,429,390 | A | | 2/1969 | Bennett |
| 3,433,331 | A | | 3/1969 | Heyberger |
| 3,455,158 | A | | 7/1969 | Richter et al. |
| 3,493,165 | A | | 2/1970 | Schonfield |
| 3,583,504 | A | | 6/1971 | Aalund |
| 3,635,296 | A | | 1/1972 | Lebourg |
| 3,700,049 | A | | 10/1972 | Tiraspolsky et al. |
| 3,732,143 | A | | 5/1973 | Joosse |
| 3,764,493 | A | | 10/1973 | Rosar |
| 3,807,512 | A | | 4/1974 | Pogonowski et al. |
| 3,815,692 | A | | 6/1974 | Varley |
| 3,821,993 | A | | 7/1974 | Kniff |
| 3,899,033 | A | | 8/1975 | Huisen |
| 3,955,635 | A | | 5/1976 | Skidmore |
| 3,960,223 | A | | 6/1976 | Kleine |
| 3,978,931 | A | | 9/1976 | Sudnishnikov et al. |
| 4,081,042 | A | | 3/1978 | Johnson |
| 4,096,917 | A | | 6/1978 | Harris |
| 4,106,577 | A | | 8/1978 | Summer |
| 4,165,790 | A | | 8/1979 | Emmerich |
| 4,176,723 | A | | 12/1979 | Arceneaux |
| 4,253,533 | A | | 3/1981 | Baker |
| 4,262,758 | A | | 4/1981 | Evans |
| 4,280,573 | A | | 7/1981 | Sudnishnikov |
| 4,304,312 | A | | 12/1981 | Larsson |
| 4,307,786 | A | | 12/1981 | Evans |
| 4,386,669 | A | | 6/1983 | Evans |
| 4,397,361 | A | | 8/1983 | Langford |
| 4,416,339 | A | | 11/1983 | Baker |
| 4,445,580 | A | | 5/1984 | Sahley |
| 4,448,269 | A | | 5/1984 | Ishikawa |
| 4,478,295 | A | | 10/1984 | Richman |
| 4,499,795 | A | | 2/1985 | Radtke |
| 4,531,592 | A | | 7/1985 | Hayatdavoudi |
| 4,535,853 | A | | 8/1985 | Ippolito |
| 4,538,691 | A | | 9/1985 | Dennis |
| 4,566,545 | A | | 1/1986 | Story |
| 4,574,895 | A | | 3/1986 | Dolezal |
| 4,583,592 | A | | 4/1986 | Gazda et al. |
| 4,592,432 | A | | 6/1986 | Williams et al. |
| 4,597,454 | A | | 7/1986 | Schoeffler |
| 4,612,957 | A | | 9/1986 | Cheek |
| 4,624,306 | A | | 11/1986 | Traver et al. |
| 4,637,479 | A | | 1/1987 | Leising |
| 4,640,374 | A | | 2/1987 | Dennis |
| 4,679,637 | A | | 7/1987 | Cherrington |
| 4,683,781 | A | | 8/1987 | Kar et al. |
| 4,732,223 | A | | 3/1988 | Schoeffler |
| 4,775,017 | A | | 10/1988 | Forrest et al. |
| 4,830,122 | A | | 5/1989 | Walter |
| 4,836,301 | A | | 6/1989 | Van Dongen et al. |
| 4,852,672 | A | | 8/1989 | Behrens |
| 4,889,017 | A | | 12/1989 | Fuller |
| 4,907,665 | A | | 3/1990 | Kar et al. |
| 4,962,822 | A | | 10/1990 | Pascale |
| 4,974,688 | A | | 12/1990 | Helton |
| 4,981,184 | A | | 1/1991 | Knowlton |
| 4,991,667 | A | | 2/1991 | Wilkes et al. |
| 5,009,273 | A | | 4/1991 | Grabinski |
| 5,027,914 | A | | 7/1991 | Wilson |
| 5,038,873 | A | | 8/1991 | Jurgens |
| 5,052,503 | A | | 10/1991 | Lof |
| 5,088,568 | A | | 2/1992 | Simuni |
| 5,094,304 | A | | 3/1992 | Briggs |
| 5,103,919 | A | | 4/1992 | Warren et al. |
| 5,119,892 | A | | 6/1992 | Clegg |
| 5,135,060 | A | | 8/1992 | Ide |
| 5,141,063 | A | | 8/1992 | Quesenbury |
| 5,148,875 | A | | 9/1992 | Karlsson et al. |
| 5,163,520 | A | | 11/1992 | Gibson et al. |
| 5,176,212 | A | | 1/1993 | Tandberg |
| 5,186,268 | A | | 2/1993 | Clegg |
| 5,222,566 | A | | 6/1993 | Taylor |
| 5,255,749 | A | | 10/1993 | Bumpurs |
| 5,259,469 | A | | 11/1993 | Stjernstrom et al. |
| 5,265,682 | A | | 11/1993 | Russell |
| 5,311,953 | A | | 5/1994 | Walker |
| 5,361,859 | A | | 11/1994 | Tibbitts |
| 5,388,649 | A | | 2/1995 | Ilomaki |
| 5,410,303 | A | | 4/1995 | Comeau |
| 5,417,292 | A | | 5/1995 | Polakoff |
| 5,423,389 | A | | 6/1995 | Warren |
| 5,475,309 | A | | 12/1995 | Hong et al. |
| 5,507,357 | A | | 4/1996 | Hult |
| 5,553,678 | A | | 9/1996 | Barr et al. |
| 5,560,440 | A | | 10/1996 | Tibbitts |
| 5,568,838 | A | | 10/1996 | Struthers |
| 5,642,782 | A | | 7/1997 | Grimshaw |
| 5,655,614 | A | | 8/1997 | Azar |
| 5,678,644 | A | | 10/1997 | Fielder |
| 5,720,355 | A | | 2/1998 | Lamine et al. |
| 5,732,784 | A | | 3/1998 | Nelson |
| 5,758,731 | A | | 6/1998 | Zollinger |
| 5,778,991 | A | | 7/1998 | Runquist et al. |
| 5,794,728 | A | | 8/1998 | Palmberg |
| 5,806,611 | A | | 9/1998 | Van Den Steen et al. |
| 5,833,021 | A | | 11/1998 | Mensa-Wilmot et al. |
| 5,864,058 | A | | 1/1999 | Chen |
| 5,896,938 | A | | 4/1999 | Moeny |
| 5,901,113 | A | | 5/1999 | Masak et al. |
| 5,904,444 | A | | 5/1999 | Kabeuchi et al. |
| 5,924,499 | A | | 7/1999 | Birchak et al. |
| 5,947,215 | A | | 9/1999 | Lundell |
| 5,950,743 | A | | 9/1999 | Cox |
| 5,957,223 | A | | 9/1999 | Doster |
| 5,957,225 | A | | 9/1999 | Sinor |
| 5,967,247 | A | | 10/1999 | Pessier |
| 5,979,571 | A | | 11/1999 | Scott |
| 5,992,547 | A | | 11/1999 | Caraway |
| 5,992,548 | A | | 11/1999 | Silva |
| 6,021,859 | A | | 2/2000 | Tibbitts |
| 6,039,131 | A | | 3/2000 | Beaton |

6,047,239 A 4/2000 Berger et al.
6,050,350 A 4/2000 Morris et al.
6,089,332 A 7/2000 Barr et al.
6,131,675 A 10/2000 Anderson
6,150,822 A 11/2000 Hong
6,186,251 B1 2/2001 Butcher
6,202,761 B1 3/2001 Forney
6,213,225 B1 4/2001 Chen
6,213,226 B1 4/2001 Eppink
6,223,824 B1 5/2001 Moyes
6,269,893 B1 8/2001 Beaton
6,296,069 B1 10/2001 Lamine
6,298,930 B1 10/2001 Sinor
6,321,658 B1 11/2001 Wentworth et al.
6,340,064 B2 1/2002 Fielder
6,363,780 B1 4/2002 Rey-Fabret
6,364,034 B1 4/2002 Schoeffler
6,364,038 B1 4/2002 Driver
6,394,200 B1 5/2002 Watson
6,439,326 B1 8/2002 Huang
6,443,249 B2 9/2002 Beuershausen
6,450,269 B1 9/2002 Wentworth et al.
6,454,030 B1 9/2002 Findley et al.
6,466,513 B1 10/2002 Pabon et al.
6,467,341 B1 10/2002 Boucher et al.
6,474,425 B1 11/2002 Truax
6,484,825 B2 11/2002 Watson
6,494,819 B1 11/2002 Harrison
6,510,906 B1 1/2003 Richert
6,513,606 B1 2/2003 Krueger
6,533,050 B2 3/2003 Molloy
6,575,236 B1 6/2003 Heijnen
6,588,518 B2 7/2003 Eddison
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,789,635 B2 9/2004 Wentworth et al.
6,822,579 B2 11/2004 Goswani
6,880,648 B2 4/2005 Edscer
6,913,095 B2 7/2005 Krueger
6,948,572 B2 9/2005 Hay et al.
6,953,096 B2 10/2005 Gledhill
7,198,119 B1 4/2007 Hall et al.
7,225,886 B1 6/2007 Hall
7,270,196 B2 9/2007 Hall
7,328,755 B2 2/2008 Hall et al.
7,337,658 B2 3/2008 Hall et al.
7,337,858 B2 3/2008 Hall et al.
7,360,610 B2 4/2008 Hall et al.
7,367,397 B2 5/2008 Clemens et al.
7,398,837 B2 7/2008 Hall et al.
7,419,016 B2 9/2008 Hall et al.
7,424,922 B2 9/2008 Hall et al.
7,426,968 B2 9/2008 Hall et al.
7,481,281 B2 1/2009 Schuaf
7,484,576 B2 2/2009 Hall et al.
7,497,279 B2 3/2009 Hall et al.
7,503,405 B2 3/2009 Hall et al.
7,506,701 B2 3/2009 Hall et al.
7,510,031 B2 3/2009 Russell et al.
7,549,489 B2 6/2009 Hall et al.
7,559,379 B2 6/2009 Hall et al.
7,591,327 B2 9/2009 Hall et al.
7,600,586 B2 10/2009 Hall et al.
7,617,886 B2 11/2009 Hall
7,624,824 B2 12/2009 Hall et al.
7,641,003 B2 1/2010 Hall et al.
2001/0054515 A1 12/2001 Eddison et al.
2002/0050359 A1 5/2002 Eddison
2003/0213621 A1 11/2003 Britten
2004/0222024 A1 11/2004 Edscer
2004/0238221 A1 12/2004 Runia
2004/0256155 A1 12/2004 Kriesels
2007/0079988 A1 4/2007 Konschuh et al.

OTHER PUBLICATIONS

Patent Cooperation Treaty, International Search Report and Written Opinion of the International Searching Authority for PCT/US07/64544, date of mailing Aug. 5, 2008.

Patent Cooperation Treaty, International Preliminary Report on Patentability, International Search Report, Written Opinion of the International Searching Authority for PCT/US06/43107, date of mailing Mar. 5, 2007.

Patent Cooperation Treaty, International Preliminary Report on Patentability and Written Opinion of the International Searching Authority for PCT/US06/43125, date of mailing Jun. 4, 2007; and the International Search Report, dated Feb. 23, 2007.

* cited by examiner

SENSOR FOR DETERMINING A POSITION OF A JACK ELEMENT

RELATED APPLICATIONS

This application is a continuation-in-part of U.S. patent application No. 11/851,094, now U.S. Pat. No. 7,721,826, which is herein incorporated by reference for all that it discloses.

FIELD OF THE INVENTION

The present invention relates generally to downhole oil, gas, and geothermal exploration and drilling, and more particularly to the field of drill bits for aiding such exploration and drilling.

BACKGROUND OF THE INVENTION

Drill bits use rotary energy provided by a drill string to cut through downhole formations and advance the tool string further into the earth Often, the drill string is directed along complex drilling trajectories to maximize drilling resources and save drilling costs.

U.S. Pat. No. 5,803,185 to Barr et at which is herein incorporated by reference for all that it contains, discloses a steerable rotary drilling system with a bottom hole assembly which includes, in addition to the drill bit, a modulated bias unit and a control unit, the bias unit comprising a number of hydraulic actuators around the periphery of the unit, each having a movable thrust member which is hydraulically displaceable outwardly for engagement with the formation of the borehole being drilled. Each actuator may be connected, through a control valve, to a source of drilling fluid under pressure and the operation of the valve is controlled by the control unit so as to modulate the fluid pressure supplied to the actuators as the bias unit rotates. If the control valve is operated in synchronism with rotation of the bias unit the thrust members impart a lateral bias to the bias unit, and hence to the drill bit, to control the direction of drilling.

U.S. Pat. No. 6,150,822 to Hong, et al., which is herein incorporated by reference for all that it contains, discloses a microwave frequency range sensor (antenna or wave guide) disposed in the face of a diamond or PDC drill bit configured to minimize invasion of drilling fluid into the formation ahead of the bit. The sensor is connected to an instrument disposed in a sub interposed in the drill stem for generating and measuring the alteration of microwave energy.

U.S. Pat. No. 6,814,162 to Moran, et al., which is herein incorporated by reference for all that it contains, discloses a drill bit, comprising a bit body, a sensor disposed in the bit body, a single journal removably mounted to the bit body, and a roller cone rotatably mounted to the single journal. The drill bit may also comprise a short-hop telemetry transmission device adapted to transmit data from the sensor to a measurement-while-drilling device located above the drill bit on the drill string.

U.S. Pat. No. 5,415,030 to Jogi, et al., which is herein incorporated by reference for all that it contains, discloses a method for evaluating formations and bit conditions. The invention processes signals indicative of downhole weight on bit (WOB), downhole torque (TOR), rate of penetration (ROP), and bit rotations (RPM), while taking into account bit geometry to provide a plurality of well logs and to optimize the drilling process.

U.S. Pat. No. 5,363,926 to Mizuno, which is herein incorporated by reference for all that it contains, discloses a device for detecting inclination of a boring head of a boring tool.

The prior art also discloses devices adapted to steer the direction of penetration of a drill string. U.S. Pat. No. 6,913,095 to Krueger, U.S. Pat. No. 6,092,610 to Kosmala, et al., U.S. Pat. No. 6,581,699 to Chen, et al., U.S. Pat. No. 2,498,192 to Wright, U.S. Pat. No. 6,749,031 to Klemm, U.S. Pat. No. 7,013,994 to Eddison, which are all herein incorporated by reference for all that they contain, discloses directional drilling systems.

BRIEF SUMMARY OF THE INVENTION

In one aspect of the present invention, a drill string has a drill bit with a bit body located between a shank and a working face. The working face has at least one cutting element and a jack element disposed partially within the drill bit body and partially protruding from the working face. The jack element is adapted to be rotated with respect to the bit body by a driving mechanism, such as a downhole turbine or motor, that is disposed within a bore of the drill string. A generator or motor with a rotor is incorporated into a torque transmitting mechanism that links the driving mechanism to the jack element, and which is configured to produce at least one waveform when the jack element is rotated. The waveform is processed by an electronic processing device to determine the rotational position of the jack element.

The electronic processing device may be incorporated into the drill bit, the bottom-hole assembly, elsewhere in the drill string, or located at a remote location that is in electric communication with a telemetry system of the drill string. In one aspect the torque transmitting mechanism may be a shaft that connects the jack element to the driving mechanism. In another aspect the torque transmitting mechanism may comprise a gear assembly. The gear assembly may have a gear ratio of 20:1 to 30:1.

The drill string may also include a position feedback sensor in electrical communication with the electronic processing device. The position feedback sensor may comprise two or more magnetically sensitive components, an optical encoder, or a mechanical switch. The magnetically sensitive components may be disposed on the torque transmitting mechanism. or proximate the torque transmitting mechanism. The magnetically sensitive components may comprise a magnet and/or a hall effect sensor, and may be powered by a downhole electrical source.

The rotation of the jack element may comprise a first angular velocity while a rotation of the drill bit comprises a second angular velocity. The first and second angular velocities may be substantially equal in magnitude and opposite in direction. The rotational position may be a relative rotational position determined by the electronic processing device. The electronic processing device may be a microcontroller.

DETAILED DESCRIPTION OF THE INVENTION AND THE PREFERRED EMBODIMENT

Figure 1:
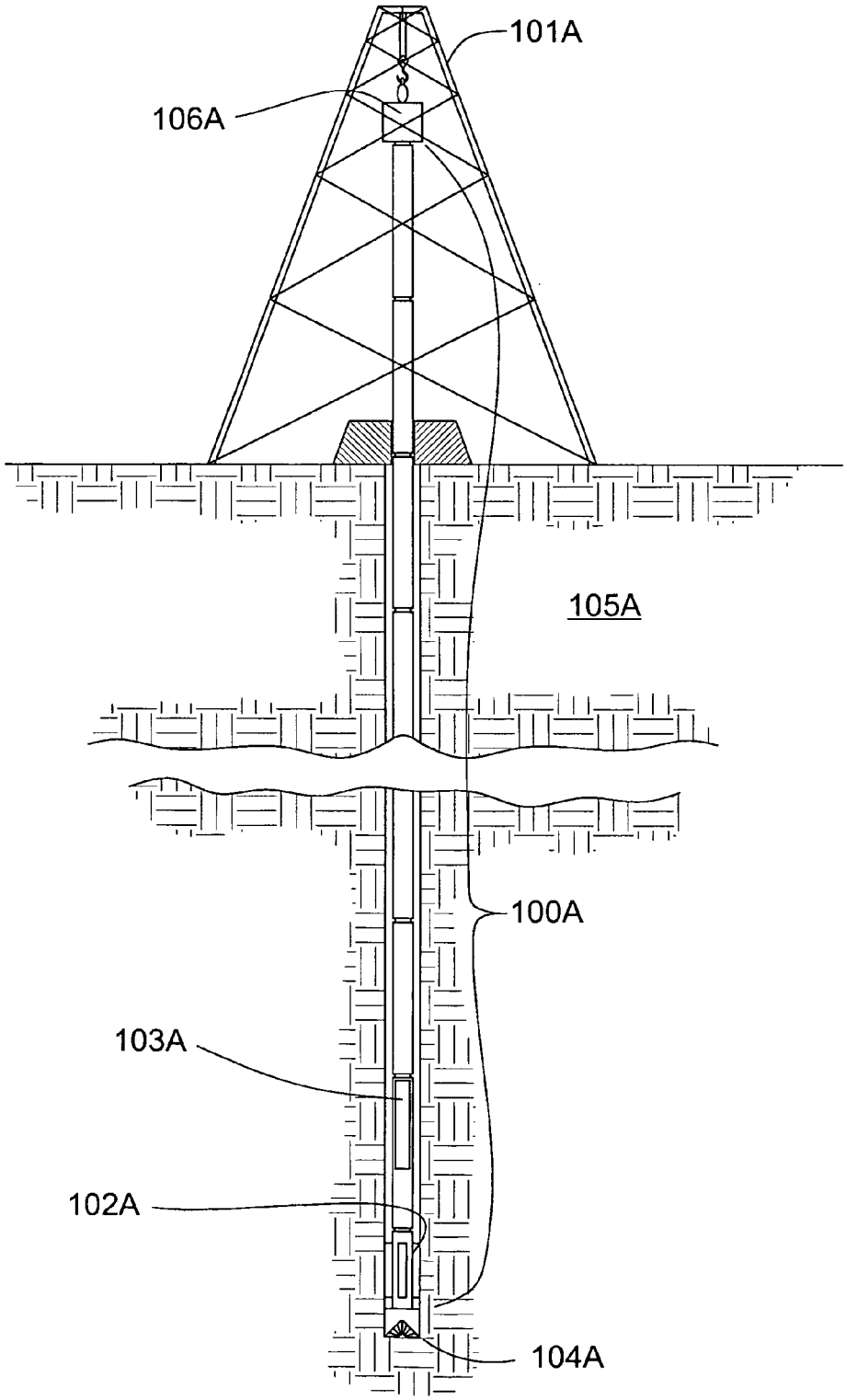
FIG. 1 is a schematic diagram of a drilling derrick and a drill string.

FIG. 1 is a schematic diagram of an embodiment of a drill string 100A suspended by a derrick 101A. A bottom-hole assembly 102A is located at the drilling end of the drill string 100A and may be at the bottom of a wellbore 103A. The drill string 100A may comprise a drill bit 104A. As the drill bit 104A rotates downhole the drill string 100A advances farther into the earth. The drill string 100A may penetrate soft and/or hard subterranean formations 105A. The drill bit 104A may be adapted to steer the drill string 100A in a desired trajectory.

The bottom-hole assembly 102A and/or downhole components may comprise data acquisition devices which may gather data. The data may be sent to the surface via a transmission system to a data swivel 106A. The data swivel 106A may send the data to the surface equipment. Further, the surface equipment may send data and/or power to downhole tools and/or the bottom-hole assembly 102A.

U.S. Pat. No. 6,670,880 to Hall et al., which is herein incorporated by reference for all that it contains, discloses a telemetry system that may be compatible with the present invention. However, other forms of telemetry may also be compatible with the present invention, such as systems that include or utilize mud pulse technology, electromagnetic waves, radio waves, and/or short hop technology. In some embodiments, no telemetry system is incorporated into the drill string.

Figure 2:
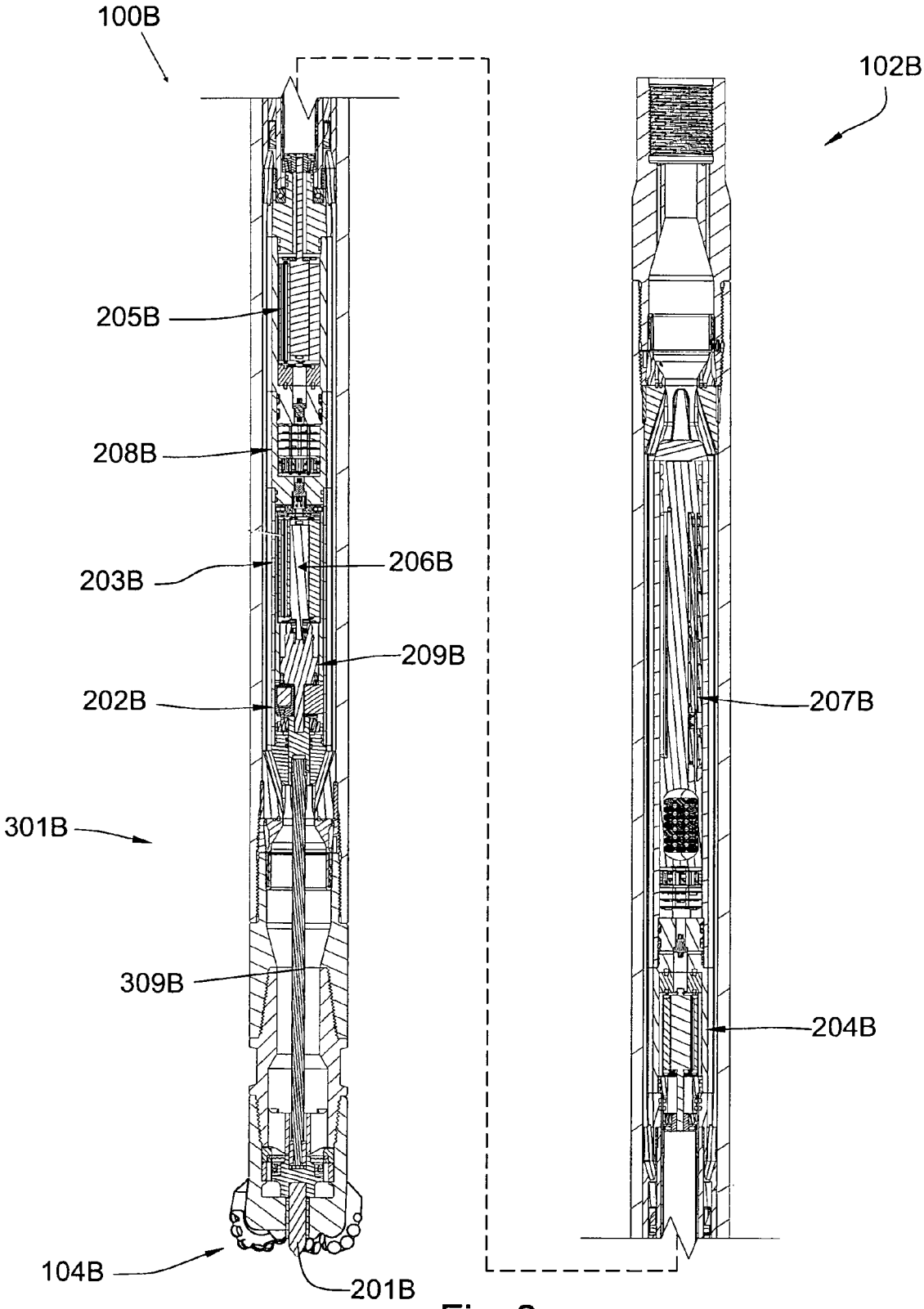
FIG. 2 is a cross-sectional diagram of an embodiment of a bottom-hole assembly of a drill string.

Referring now to FIG. 2, a cross-sectional diagram of a drill string 100B discloses an embodiment of the bottom-hole assembly (BRA) 102B. A jack element 201B may protrude beyond the working face of the drill bit. The jack element 201B may rotate around an axis independent of the drill bit and may be used for steering the drill string. The drill string comprises at least one position feedback sensor 202B that is adapted to detect a position and/or orientation of the jack element 201B. Rotation of the jack element 201B may be powered by a driving mechanism, such as a downhole turbine 206B and/or generator or motor 203B.

A power source 204B may provide electricity to a direction and inclination (D&I) package 207B. D&I package 207B may monitor the orientation of the BHA 102B with respect to some relatively constant object, such as the center of the planet, the moon, the surface of the planet, a satellite, or combinations thereof. A second power source 205B may provide electrical power to an electronic processing device 208B.

The electronic processing device 208B may be incorporated into the drill bit 104B, the bottom-hole assembly 102B, elsewhere in the drill string 100B, or located at a remote location that is in electric communication with a telemetry system of the drill string 100B. The electronic processing device 208B may be a microcontroller. The electronic processing device 208B may control steering and/or motor functions. The electronic processing device 208B may receive drill string orientation information from the D&I package 207B and may alter the speed or direction of the turbine 206B and/or the generator or motor 203B.

In the embodiment shown in FIG. 2, a torque transmitting mechanism, such as a jack assembly 301B, connects the turbine 206B to the jack element 201B via a gear assembly 209B and a shaft 309B. The gear assembly 209B may couple rotation of the turbine 206B to rotation of the jack element 201B. In some embodiments, the gear assembly may have a gear ratio of 20/1 to 30/1.

The jack assembly 301B, the turbine 206B, and portions of the generator or motor 203B may be adapted to rotate independent of the drill string 100B. In some embodiments one or more of the power source 204B, second power source 205B, electronic processing device 208B, D&I package 207B, or some other electrical component, may be rotationally isolated from the drill string 100B as well.

Figure 3:
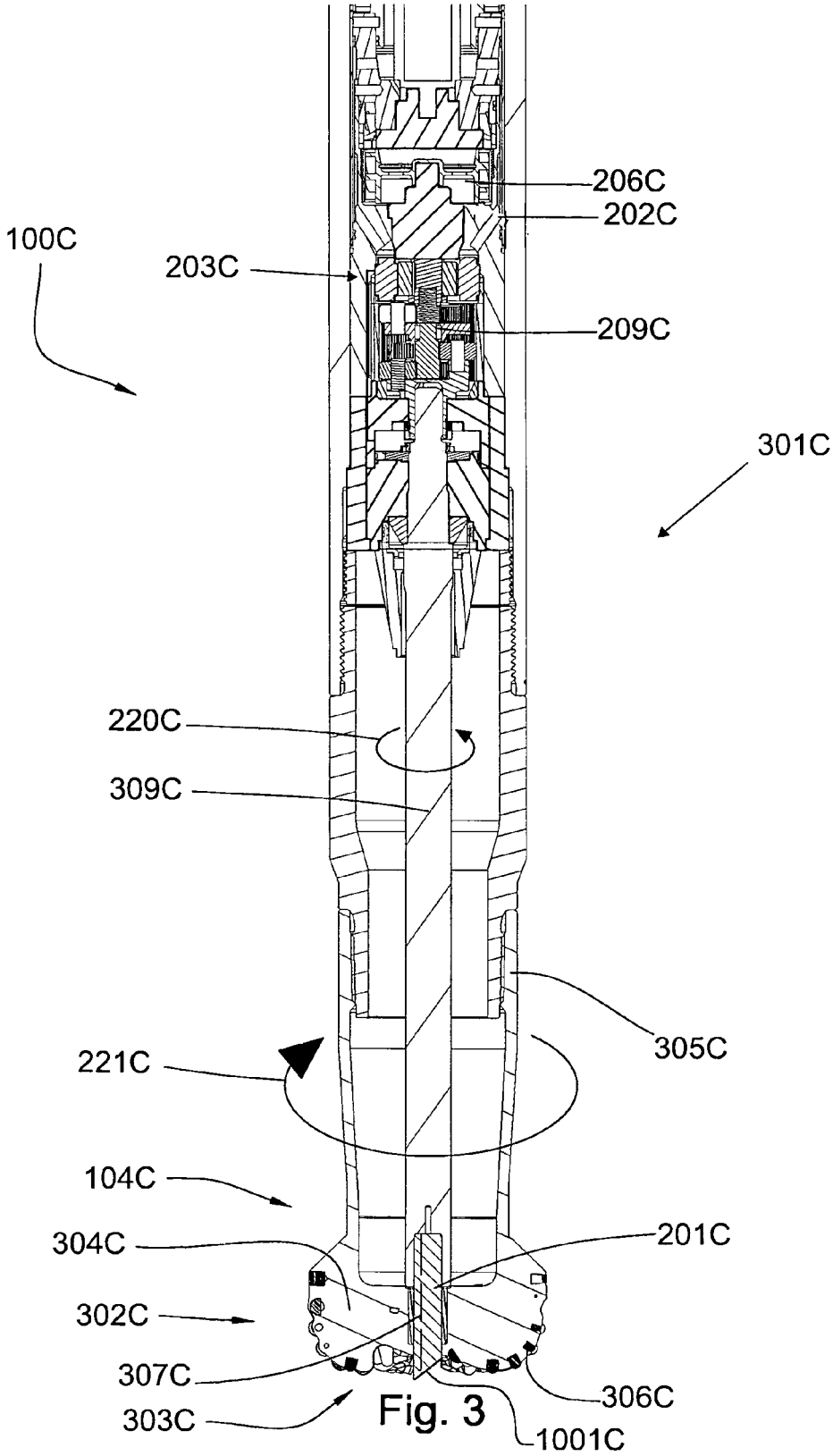
FIG. 3 is a cross-sectional diagram of a portion of another embodiment of the bottom-hole assembly of the drill string.

FIG. 3 discloses another embodiment of the bottom-hole assembly having a jack assembly 301C that includes a shaft 309C, a turbine 206C and a gear assembly 209C. The jack element 201C may be disposed on a distal end 302C of the jack assembly 301C, may substantially protrude from a working face 303C of the drill bit 104C, and may be adapted to move with respect to a bit body 304C of the drill bit 104C. The bit body 304C may be disposed intermediate a shank 305C and the working face 303C. The working face 303C may comprise at least one cutting element 306C. In the present embodiment the working face may comprise a plurality of cutting elements 306C.

The generator or motor 203C may comprise a plurality of magnets mechanically attached to a rotor incorporated into the torque transmitting mechanism, and a plurality of coils rotationally fixed to the drill string 100C. As the rotor of the generator or motor 203C is spun by the turbine 206C, an output signal may be generated in the coils that travel to the electronic processing device (not shown). This signal may be reflective of the shaft/jack element's RPM. The RPM measurement may be used to determine a relative rotational position of the shaft 309C. Additionally, a position feedback sensor 202C, which also measures the rotational position of the shaft/jack element 201C, may be in electrical communication with the electronic processing device.

The position feedback sensor may be mechanically associated with the turbine 206C, any part of the torque transmitting mechanism such the shaft 309C or the gears in the gear assembly 209C, and/or combinations thereof. As the signals from the generator or motor 203C and position feedback sensor 202C are received at the electronic processing device, they may be analyzed together to give an accurate depiction of the jack element's relative rotational position to the drill string 100C. Knowledge of the jack element's 201C rotational position with respect to the drill string 100C from the electronic processing device coupled with knowledge of the drill string's position from the D & I package may provide a knowledge of the jack element's rotational position with respect to the earth.

In the embodiment of FIG. 3, the jack element 201C comprises a primary deflecting surface 1001C disposed on a distal end of the jack element 201C. The deflecting surface 1001C may form an angle relative to a central axis 307C of the jack element 201C of 15 to 75 degrees. The angle may create a directional bias in the jack element 201C. The deflecting surface 1001C of the jack element 201C may cause the drill bit 104C to drill substantially in a direction indicated by the directional bias of the jack element 201C. By controlling the rotational orientation of the deflecting surface 1001C in relation to the drill bit 104C or to some fixed object the direction of drilling may be controlled. In some drilling applications, the drill bit 104C, when desired, may drill 6 to 20 degrees per 100 feet drilled. In some embodiments, the jack element 201C may be used to steer the drill string 104C in a straight trajectory if the formation 105C comprises characteristics that tend to steer the drill string 104C in an opposing direction.

The shaft 309C/jack element 201C may be adapted to rotate in a direction opposite the direction of rotation of the drill bit 104C. A gear assembly 209C may connect the turbine 206C to the shaft 309C. The turbine 206C and/or gear assembly 309C may cause the jack element 201C to rotate opposite direction of rotation of the drill string 100C. The shaft 309C may rotate at a first angular velocity, represented at 220C, while the drill string 100C may rotate at a second angular velocity, presented at 221C. The first and second angular velocities may be substantially equal in magnitude.

Figure 4:
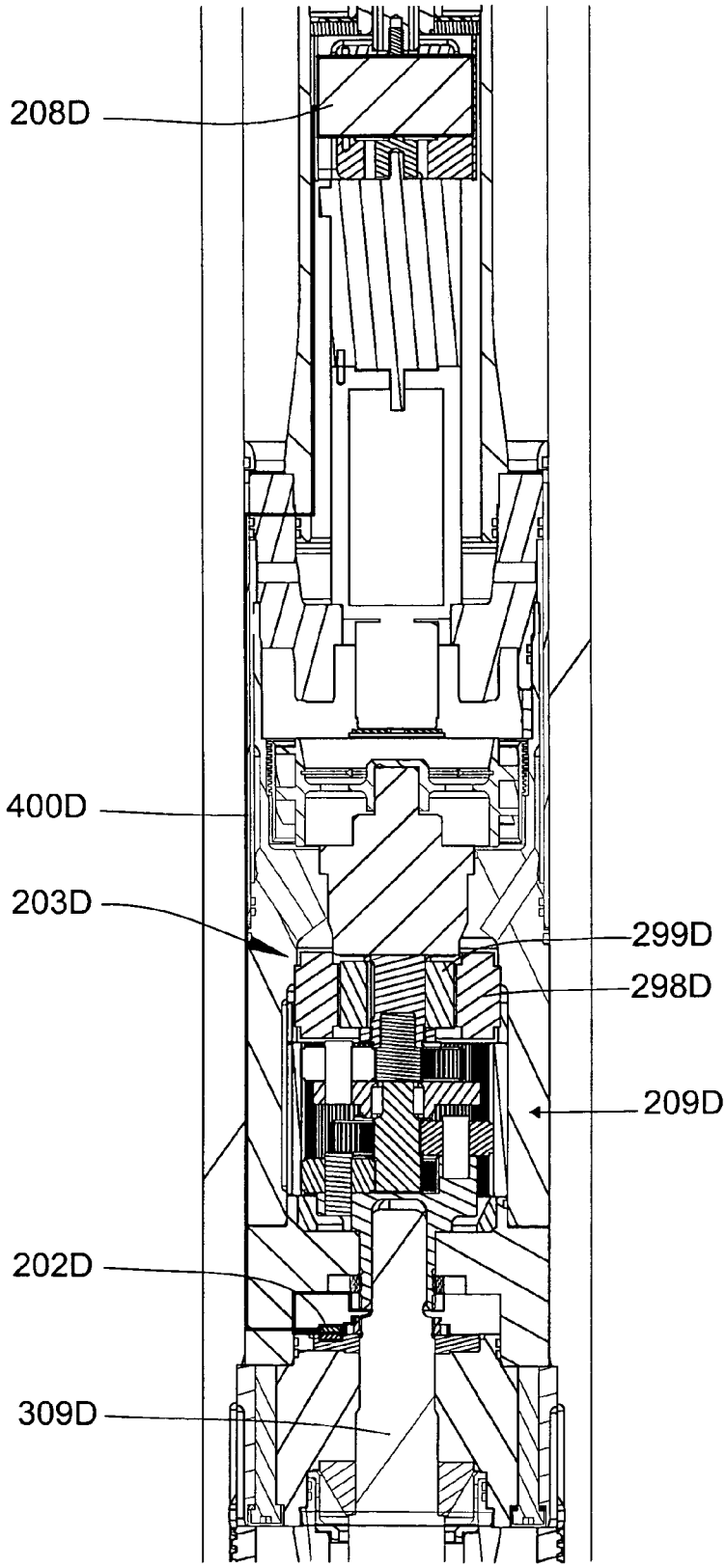
FIG. 4 is a cross-sectional diagram of a portion of another embodiment the drill string.

FIG. 4 discloses the position feedback sensor 202D being positioned adjacent to the shaft 309D and below the gear assembly 209D. As the position feedback sensor 202D gathers data, it may produce a signal that may be sent to the electronic processing device 208D through a wire 400D or by other means.

The generator or motor 203D may also be in electrical communication with the electronic processing device 208D. The generator or motor 203D may comprise a magnet element 299D and a coil element 298D from which the signal is produced.

The electronic processing device 208D may be in electrical communication with a downhole telemetry network. The electronic processing device 208D may also be in electrical communication with the D & I package.

Figure 5:
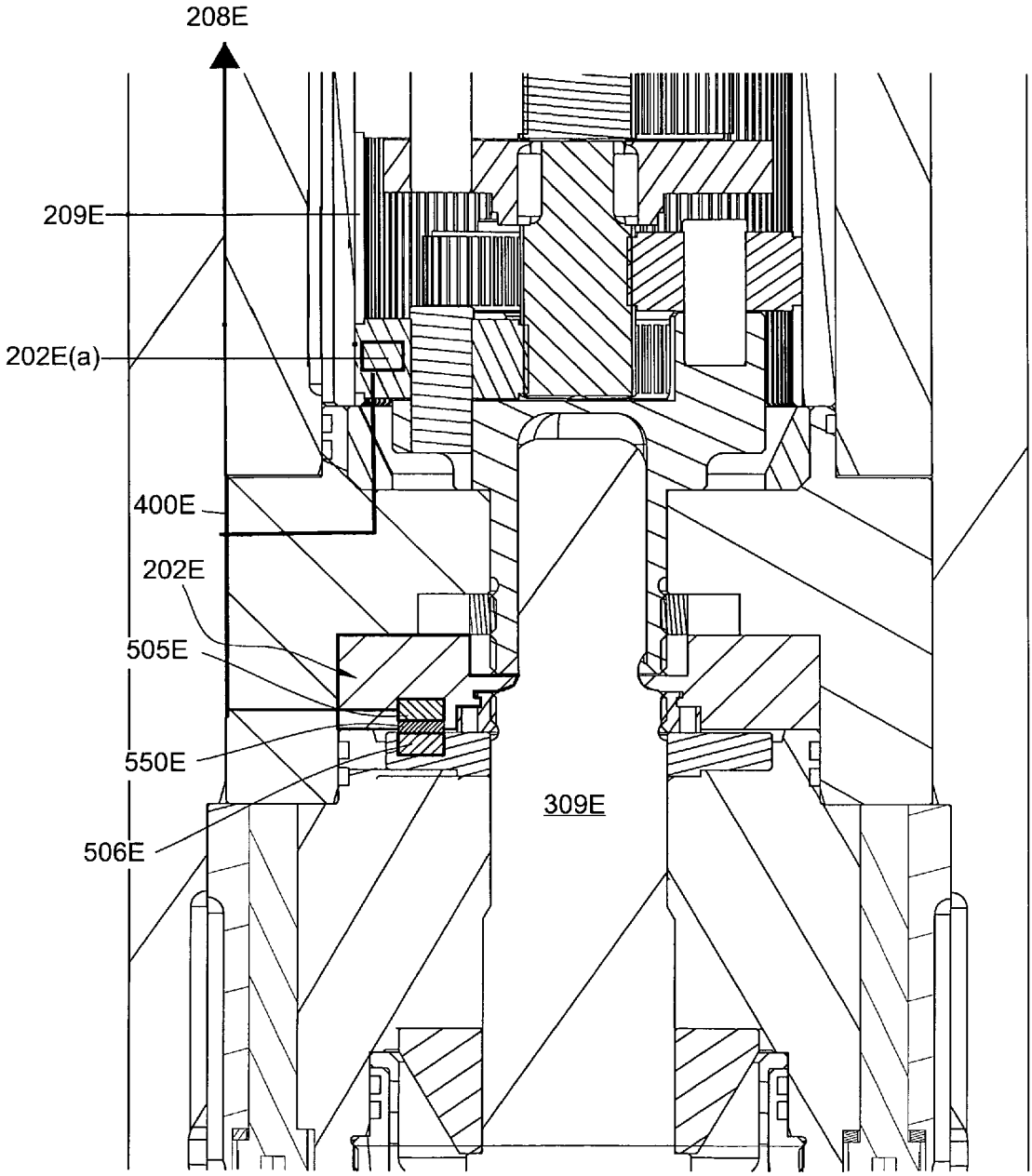
FIG. 5 is a cross-sectional diagram of a portion of another embodiment of the drill string.

FIG. 5 discloses a first position feedback sensor 202E with at least two magnetically sensitive components 505E, 506E which are mechanically associated with the shaft 309E. The two magnetically sensitive components 505E, 506E may comprise a magnet and/or a hall effect sensor. As the shaft 309E rotates, magnetically sensitive components 506E may pass magnetically sensitive components 505E. As it passes, a signal or pulse may be generated and sent to the electronic processing device 208E through the communications wire 400E.

The position feedback sensor 202E may be resistant to downhole pressures. The position feedback sensor 202E may be encased in a pressure resistant vessel 550E adapted to withstand the pressures inherent in downhole drilling. In other embodiments, the position feedback sensor may be covered in a pressure resistant epoxy.

Also disclosed in FIG. 5, a second position feedback sensor 202E(*a*) may be mechanically associated with the gear assembly 209E. In other embodiments, the position feedback sensor may be mechanically associated with the turbine (as referenced in FIG. 3 as 202C).

Figure 6A:
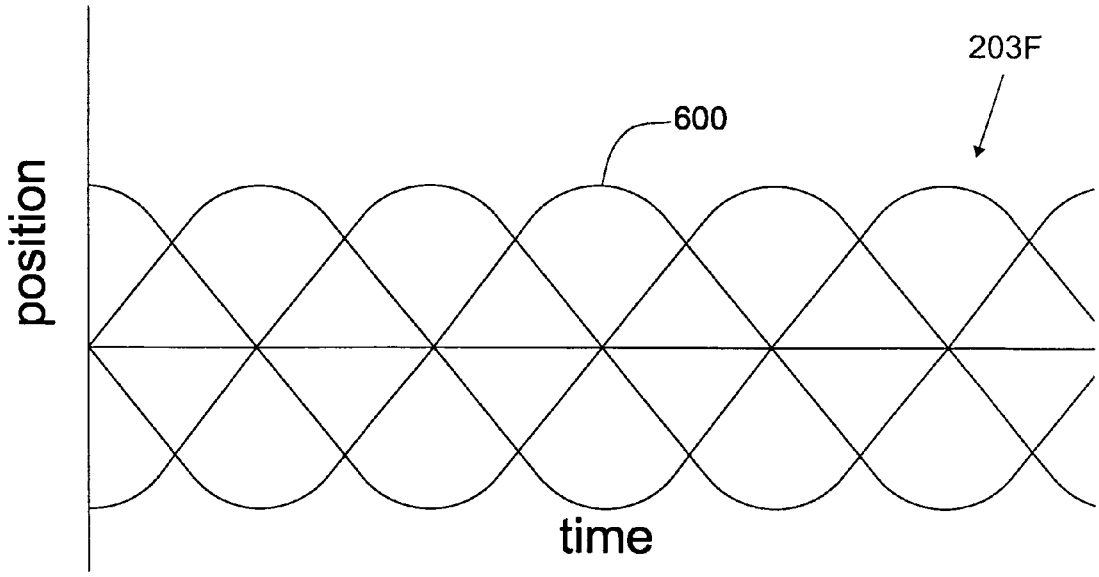
FIG. 6*a* is a diagram of an embodiment of a waveform.

FIG. 6*a* is a diagram of an embodiment of a waveform 600 created by the generator or motor 203F as the shaft rotates. The waveform 600 displays the rotational position of the shaft compared to time. As the shaft rotates, a relative rotational position of the shaft may be ascertained from the waveform 600. Using data gathered from the D & I package, the exact position of the shaft may be determined, thus giving the exact rotational position of the jack element by comparing the relative position of the shaft and the exact position of the drill string.

Figure 6B:
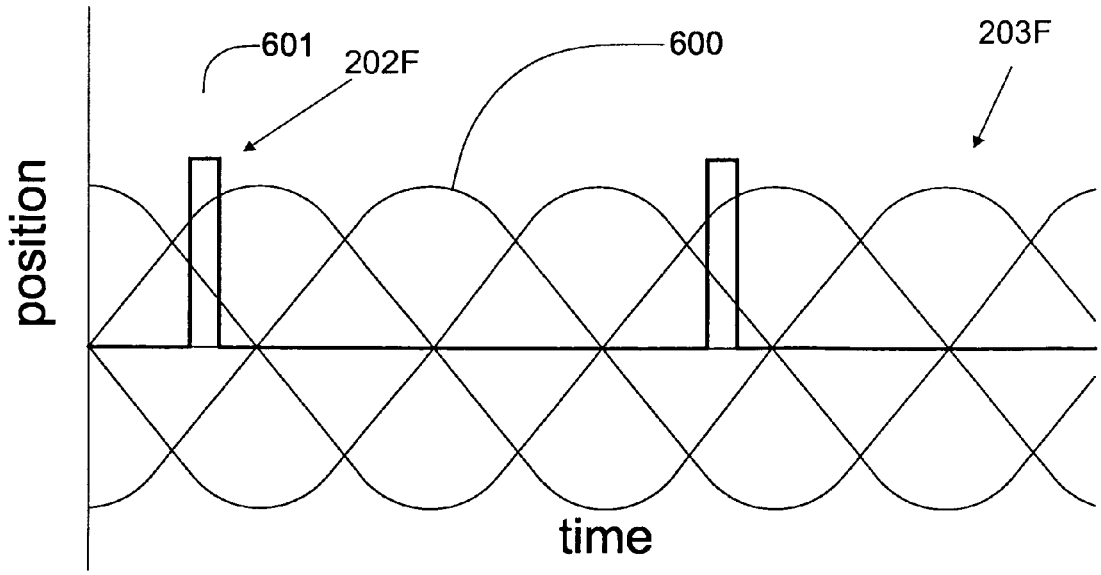
FIG. 6*b* is a diagram of another embodiment of a waveform.

FIG. 6*b* discloses the waveforms 600 from the generator or motor 203F combined with a signal or pulse 601 from the position feedback sensor 202F. These signals are displayed as functions of position and time. This consistent periodic pulse or spike may be used to calibrate the signal from the generator or motor. Over time, due to heat, mechanical stress, material elastic yields, vibration, and/or pressure, the readings from the generator may drift. The position feedback sensor's signal 601 may pulse as its components cross once every rotation. In some embodiments, a plurality of position feedback sensors may be used at different azimuths to help calibrate the generator's signal.

Figure 7:
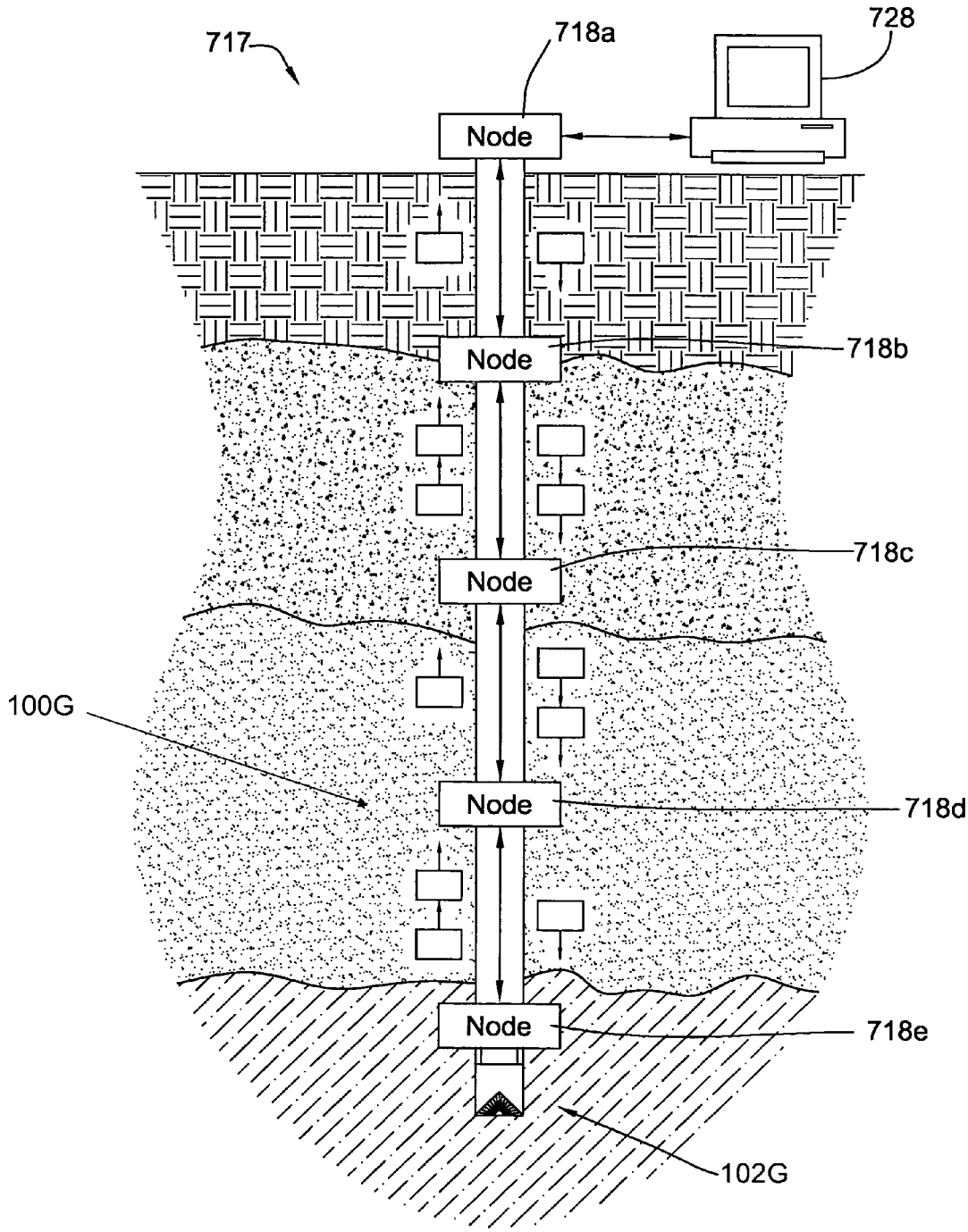
FIG. 7 is a schematic diagram of an embodiment of a telemetry system for a drill string.

FIG. 7 discloses a downhole network 717 that may be used to transmit information along a drill string 100G. The network 717 may include multiple nodes 718*a-e* spaced up and down the drill string 100G. The nodes 718*a-e* may be intelligent computing devices 718*a-e*, or may be less intelligent connection devices, such as hubs or switches located along the length of the network 717. Each of the nodes 718 may or may not be addressed on the network 717. A node 718*e* may be located to interface with a bottom-hole assembly 102G located at the end of the drill string 100G. The bottom-hole assembly 102G may include a drill bit, drill collar, and other downhole tools and sensors designed to gather data and perform various tasks.

As signals from the downhole tools are obtained, they may be transmitted uphole or downhole using the downhole network 717. The downhole network may also assist the downhole tools in communicating with each other. The downhole network 717 may be in electrical communication with an uphole computing device 728. The electronic processing device and D&I package, which may be located in the bottonhole assembly 102G, may also be in electrical communication with the downhole network 717.

Transmitting the jack element's orientation signal to the surface may allow drillers to make real time decision and correct drill string trajectories that are off of the desired path before trajectory correction. In some embodiments, the signal may be transmitted wirelessly to off site locations once the signal is at the surface. Such an embodiment would allow drilling experts to position themselves in a central location and monitor multiple wells at once.

Figure 8:
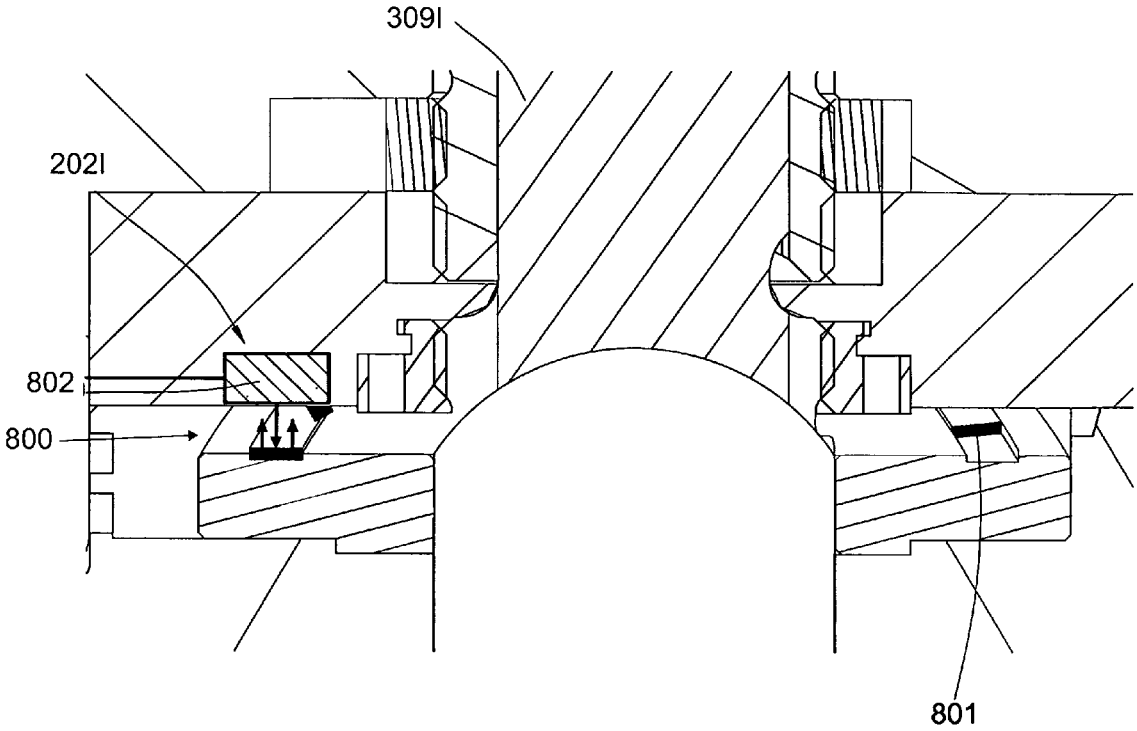
FIG. 8 is a cross-sectional diagram of a portion of another embodiment of the drill string.

FIG. 8 discloses a position feedback sensor 202I with an optical encoder 800. The optical encoder 800 may comprise mirrors 801 and a reader 802. The mirrors 801 may reflect back a signal sent from the reader 800 to determine a rotation position of the shaft 309I. The optical encoder 800 may be powered by a downhole electrical source such as the power source.

Figure 9:
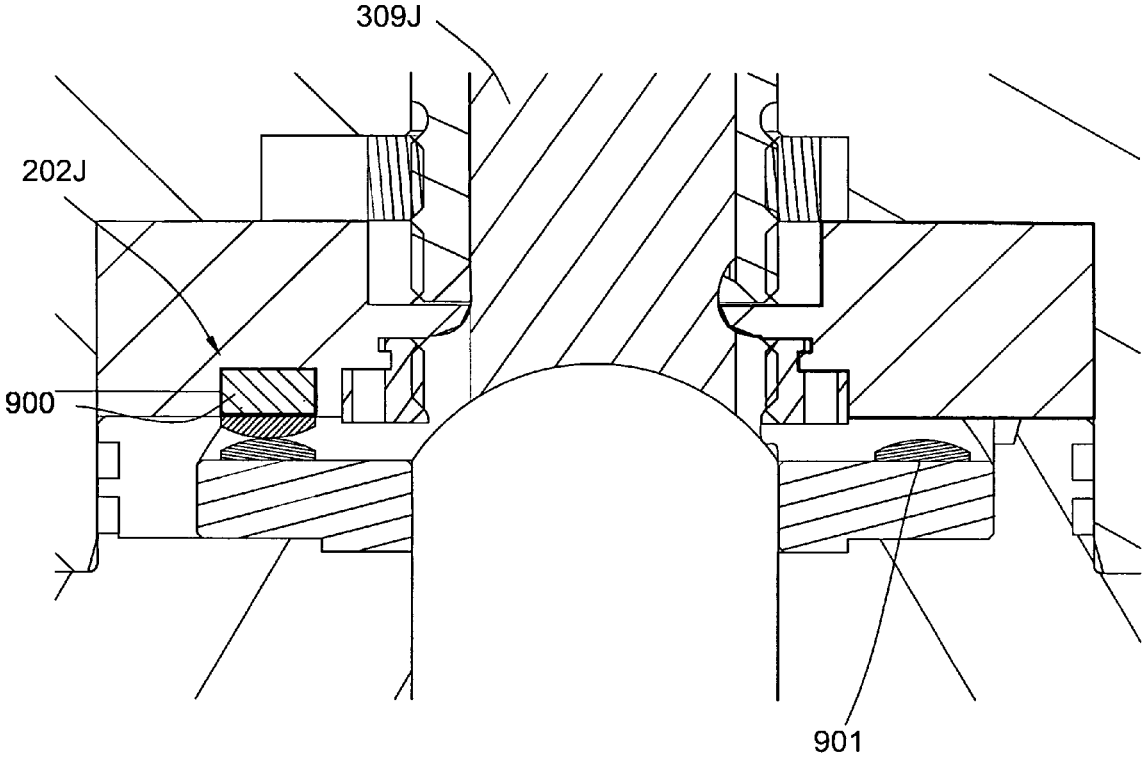
FIG. 9 is a cross-sectional diagram of a portion another embodiment of the drill string.

FIG. 9 discloses a position feedback sensor 202J with a mechanical switch 900 adapted to track the position of the shaft 309. As the shaft 309J turns, the mechanical switch 900 may track the position of the shaft 309J by detecting the mechanical contact of the switch components 901 with each other as they pass.

In some embodiments, the position feedback sensor comprises a resolver, a coil, a magnetic, piezoelectric material, magnetostrictive material, or combinations there.

Whereas the present invention has been described in particular relation to the drawings attached hereto, it should be understood that other and further modifications apart from those shown or suggested herein, may be made within the scope and spirit of the present invention.

What is claimed is:

1. A drill string for positioning within a bore of a well, the drill string comprising:

a drill bit, the drill bit having a bit body intermediate a shank and a working face, the working face comprising at least one cutting element, the drill bit being configured to rotate with respect to the bore of the well;

a jack element, the jack element being positioned within the bit body and substantially protruding from the working face; the jack element being configured to be rotated with respect to the bit body by a driving mechanism disposed within a bore of the drill string;

a generator, the generator including a rotor incorporated into a torque transmitting mechanism linking the driving mechanism to the jack element, the generator being configured to generate and supply a waveform signal reflective of a rotational position of the jack element upon rotation of the jack element with respect to the bit body; and an electronic processing device, the electronic processing device being in electrical communication with the generator, the electronic processing device being configured to receive and process the waveform signal to determine the rotational position of the jack element with respect to the bit body.

2. The drill string of claim 1, wherein a location of the electronic processing device is selected from the group consisting of the drill bit, the down-hole assembly, the drill string, and a remote location in electrical communication with a telemetry system of the drill string.

3. The drill string of claim 1, wherein the torque transmitting mechanism comprises a shaft configured to connect the jack element to the driving mechanism.

4. The drill string of claim 1, wherein the torque transmitting mechanism comprises a gear assembly.

5. The drill string of claim 4, wherein the gear assembly comprises a gear ratio of 20:1 to 30:1.

6. The drill string of claim 1, further comprising a position feedback sensor in electrical communication with the electronic processing device and configured to generate and supply a pulse signal reflective of the rotational position of the jack element upon rotation of the jack element with respect to the bit body.

7. The drill string of claim 6, wherein the position feedback sensor comprises at least two magnetically sensitive components.

8. The drill string of claim 7, wherein at least one of the two magnetically sensitive components is disposed on the torque transmitting mechanism.

9. The drill string of claim 7, wherein at least one of the two magnetically sensitive components is disposed proximate the torque transmitting mechanism.

10. The drill string of claim 7, wherein at least one of the two magnetically sensitive components comprises a hall effect sensor.

11. The drill string of claim 7, wherein at least one of the two magnetically sensitive components is powered by a downhole electrical source.

12. The drill string of claim 6, wherein the position feedback sensor is mechanically associated with a gear of the gear assembly.

13. The drill string of claim 6, wherein the position feedback sensor is mechanically associated with the driving mechanism.

14. The drill string of claim 6, wherein the electronic processing device is configured to receive and process the pulse signal with the waveform signal to determine the rotational position of the jack element with respect to the bit body.

15. The drill string of claim 1, wherein the rotation of the jack element comprises a first angular velocity and the rotation of the drill bit comprises a second angular velocity, wherein the first and second angular velocities are substantially equal in magnitude and opposite in direction.

16. The drill string of claim 6, wherein the position feedback sensor is in communication with the turbine.

17. A drill string for positioning within a bore of a well, said drill string having a drilling end and a bore formed therethrough, said drill string comprising:

a drill bit, said drill bit including a bit body having a shank end, a working end and a bit bore formed therethrough, said shank end having a shank for attachment to said drilling end, said working end having a working face formed therein, said working face comprising at least one cutting element, said drill bit being configured to rotate in a first direction with respect to said bore of said well;

a driving mechanism, said driving mechanism being located within said bore of said drill string, said driving mechanism being configured to rotate in a second direction;

a jack element, said jack element being positioned within said bit bore and substantially protruding from said working face, said jack element being configured to rotate with respect to said bit body;

a torque transmitting mechanism, said torque transmitting mechanism connecting said driving mechanism with said jack element, said torque transmitting mechanism being configured to rotate said jack element in a direction opposite said first direction;

a generator, said generator including a rotor incorporated into said torque transmitting mechanism, said generator being configured to generate and supply a waveform signal reflective of said rotational position of said jack element upon rotation of said jack element with respect to said bit body; and an electronic processing device, said electronic processing device being in electrical communication with said generator, said electronic processing device being configured to receive and process said waveform signal to determine said rotational position of said jack element with respect to said bit body.

18. The drill string of claim 17, further comprising a position feedback sensor in electrical communication with said electronic processing device, said position feedback sensor being configured to generate and supply a pulse signal reflective of said rotational position of said jack element upon rotation of said jack element with respect to said bit body.

19. The drill string of claim 18, wherein said electronic processing device is configured to receive and process said tach pulse signal with said waveform signal to determine said rotational position of said jack element with respect to said bit body.

20. A drill string for positioning within a bore of a well, said drill string having a drilling end and a bore formed therethrough, said bottom-hole comprising:

a drill bit, said drill bit including a bit body having a shank end, a working end and a bit bore formed therethrough, said shank end having a shank for attachment to said drilling end, said working end having a working face formed therein, said working face comprising at least one cutting element, said drill bit being configured to rotate in a first direction with respect to said bore of said well;

a driving mechanism, said driving mechanism being located within said bore of said drill string, said driving mechanism being configured to rotate in a second direction;

a jack element, said jack element being positioned within said bit bore and substantially protruding from said working face, said jack element being configured to rotate with respect to said bit body;

a torque transmitting mechanism, said torque transmitting mechanism connecting said driving mechanism with said jack element, said torque transmitting mechanism being configured to rotate said jack element in a direction opposite said first direction;

a generator, said generator including a rotor incorporated into said torque transmitting mechanism, said generator being configured to generate and supply a waveform signal reflective of said rotational position of said jack element upon rotation of said jack element with respect to said bit body;

a position feedback sensor, said position feedback sensor being configured to generate and supply a tach pulse signal reflective of said rotational position of said jack element upon rotation of said jack element with respect to said bit body; and an electronic processing device, said electronic processing device being in electrical communication with each of said generator and said position feedback sensor, said electronic processing device being configured to receive and process each of said waveform signal and said tach pulse signal to determine said rotational position of said jack element with respect to said bit body.

* * * * *

UNITED STATES PATENT AND TRADEMARK OFFICE

CERTIFICATE OF CORRECTION

PATENT NO. : 7,967,083 B2
APPLICATION NO. : 12/614668
DATED : June 28, 2011
INVENTOR(S) : David R. Hall et al.

It is certified that error appears in the above-identified patent and that said Letters Patent is hereby corrected as shown below:

On the Title Page

Left column, item (63), replace "11/851,095," with --11/851,094,--.

In the Claims

In column 7, delete claim 8 in its entirety and replace with --8. The drill string of claim 6, wherein the position feedback sensor comprises a pressure resistant material.--.

In column 7, delete claim 9 in its entirety and replace with --9. The drill string of claim 6, wherein the position feedback sensor comprises an optical encoder.--.

In column 7, delete claim 10 in its entirety and replace with --10. The drill string of claim 6, wherein the position feedback sensor comprises a mechanical switch.--.

In column 7, delete claim 11 in its entirety and replace with --11. The drill string of claim 7, wherein at least one of the two magnetically sensitive components comprises a hall effect sensor.--.

In column 7, delete claim 16 in its entirety and replace with --16. The drill string of claim 1, wherein the electronic processing device is a microcontroller.--.

Signed and Sealed this
Fifth Day of March, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 7,967,083 B2
APPLICATION NO. : 12/614668
DATED : June 28, 2011
INVENTOR(S) : David R. Hall et al.

It is certified that error appears in the above-identified patent and that said Letters Patent is hereby corrected as shown below:

On the Title Page

Left column, item (63), replace "11/851,095," with --11/851,094,--.

In the Claims

In column 7, lines 39-41, delete claim 8 in its entirety and replace with --8. The drill string of claim 6, wherein the position feedback sensor comprises a pressure resistant material.--.

In column 7, lines 42-44, delete claim 9 in its entirety and replace with --9. The drill string of claim 6, wherein the position feedback sensor comprises an optical encoder.--.

In column 7, lines 45-47, delete claim 10 in its entirety and replace with --10. The drill string of claim 6, wherein the position feedback sensor comprises a mechanical switch.--.

In column 7, lines 48-50, delete claim 11 in its entirety and replace with --11. The drill string of claim 7, wherein at least one of the two magnetically sensitive components comprises a hall effect sensor.--.

In column 7, lines 66-67, delete claim 16 in its entirety and replace with --16. The drill string of claim 1, wherein the electronic processing device is a microcontroller.--.

This certificate supersedes the Certificate of Correction issued March 5, 2013.

Signed and Sealed this
Ninth Day of April, 2013

Teresa Stanek Rea
*Acting Director of the United States Patent and Trademark Office*